US007473159B2

(12) United States Patent
Economikos et al.

(10) Patent No.: US 7,473,159 B2
(45) Date of Patent: Jan. 6, 2009

(54) DETECTION OF DIAMOND CONTAMINATION IN POLISHING PAD AND RECONDITIONING SYSTEM THEREFOR

(75) Inventors: Laertis Economikos, Wappingers Falls, NY (US); John Fitzsimmons, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/951,616

(22) Filed: Dec. 6, 2007

(65) Prior Publication Data

US 2008/0076331 A1 Mar. 27, 2008

Related U.S. Application Data

(63) Continuation of application No. 10/905,816, filed on Jan. 21, 2005, now Pat. No. 7,354,333.

(51) Int. Cl.
*B24B 49/00* (2006.01)
*B24B 51/00* (2006.01)

(52) U.S. Cl. ..... 451/6; 451/8; 451/21; 451/72; 451/443

(58) Field of Classification Search ..... 451/6, 451/8, 21, 56, 59, 72, 443
See application file for complete search history.

(56) References Cited

U.S. PATENT DOCUMENTS

| | | | |
|---|---|---|---|
| 4,919,533 | A | 4/1990 | Bowley et al. |
| 5,118,181 | A | 6/1992 | Yifrach et al. |
| 5,143,224 | A | 9/1992 | Burchell |
| 5,811,824 | A | 9/1998 | Smith et al. |
| 5,835,205 | A | 11/1998 | Hunter et al. |
| 6,241,587 | B1 | 6/2001 | Drill et al. |
| 6,752,708 | B1 | 6/2004 | Kinoshita et al. |
| 6,852,004 | B2 | 2/2005 | Chu et al. |
| 6,852,016 | B2 | 2/2005 | Henderson |
| 6,857,942 | B1 | 2/2005 | Lin et al. |
| 7,102,742 | B2 | 9/2006 | Geurts |
| 2002/0194790 | A1 | 12/2002 | Wang et al. |
| 2004/0206453 | A1 | 10/2004 | Chu et al. |
| 2006/0025056 | A1 | 2/2006 | Henderson |

OTHER PUBLICATIONS

Guarnieri et al., "Dry Patterning Process for Diamond-Particle Seed Layers", IBM Technical Diclosure Bulletin, vol. 36, No. 4, Apr. 1993, pp. 35-37.

*Primary Examiner*—Timothy V Eley
(74) *Attorney, Agent, or Firm*—Lisa Jaklitsch; Hoffman WarnickLLC

(57) ABSTRACT

A reconditioning system for reconditioning a damaged polishing pad is disclosed. The reconditioning system includes a reconditioning disk including a plurality of diamonds for reconditioning the polishing pad, wherein each diamond fluoresces when being exposed to a light energy source.

8 Claims, 3 Drawing Sheets

DETECTION OF DIAMOND CONTAMINATION IN POLISHING PAD AND RECONDITIONING SYSTEM THEREFOR

CROSS REFERENCE TO RELATED APPLICATIONS

This application is a continuation application of U.S. Pat. Appl. Ser. No. 10/905,816, filed Jan. 21, 2005, now U.S. Pat. No. 7,354,333, which issued Apr. 8, 2008.

BACKGROUND OF THE INVENTION

1. Technical Field

The present invention relates generally to chemical mechanical polishing, and more particularly, to methods of detecting diamond contamination of a polishing pad.

2. Related Art

Chemical mechanical polishing (CMP) is a method of removing layers of solid for the purpose of surface planarization and definition of metal interconnect patterns, and is a key process in back-end of line integrated circuit (IC) manufacturing. Typically, CMP is carried out using a revolving pad in a slurry to polish a semiconductor wafer. The polishing pad is made of a porous polymeric material that retains the slurry on or within the pad. During use, the polishing pad surface may become damaged, which prevents the polishing pad from providing consistent etching rates and makes the pad unusable. In order to address this situation, polishing pads are reconditioned by applying a reconditioning disk to the polishing pad that contains an abrasive in the form of diamonds. One problem with this process is that the diamonds oftentimes fall off the reconditioning disk and may become embedded in the polishing pad or otherwise contacted to the polishing pad, which results in catastrophic polishing scratches on a wafer being polished.

In view of the foregoing, there is a need in the art for methods of reconditioning a polishing pad and detecting diamond contamination thereof.

SUMMARY OF THE INVENTION

Embodiments of the Present invention provide a reconditioning system for reconditioning a damaged polishing pad. The system includes a reconditioning disk that contains multiple diamonds for reconditioning the polishing pad, wherein every diamond on the reconditioning disk fluoresces when exposed to a light energy source.

According to one embodiment, the system further includes a light energy source for causing diamond contamination of at least one diamond of the multiple diamonds being embedded in or contacting the polishing and to fluoresce during exposure of the polishing pad by the light energy source, wherein the diamond of the multiple diamonds is embedded in or contacts the polishing pad.

According to another embodiment, the system further includes a detector for detecting diamond contamination of the polished pad by the fluorescence of the diamond of the multiple diamonds being embedded in or contacting the polishing pad.

In one embodiment, the detector is positioned in a plane substantially parallel to the light energy source.

According to vet another embodiment, the system further includes a filter for filtering the fluorescence.

BRIEF DESCRIPTION OF THE DRAWINGS

The embodiments of this invention will be described in detail, with reference to the following figures, wherein like designations denote like elements, and wherein.

DETAILED DESCRIPTION

Figure 1:
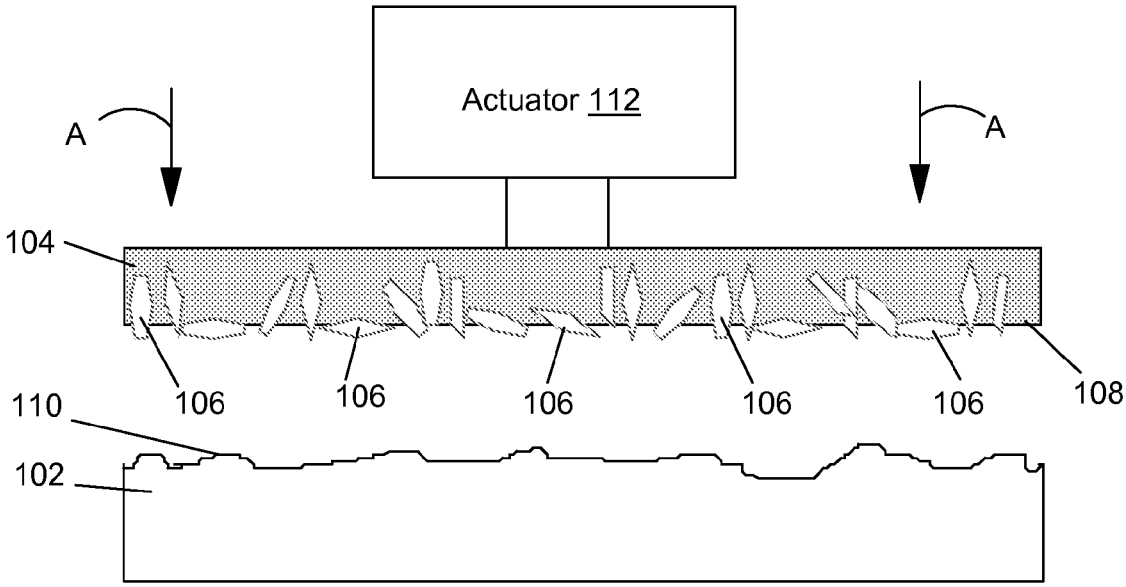
FIG. 1 shows a reconditioning disk and a polishing pad according to the invention.

With reference to the accompanying drawings, FIG. 1 shows a polishing pad 102 and a conventional reconditioning disk 104 including a plurality of diamonds 106 attached on a reconditioning surface 108 thereof. Polishing pad 102 includes a damaged surface 110 that makes polishing pad 102 unusable. Polishing pad 102 may be made of any now known or later developed porous polymeric material that retains a polishing slurry (not shown) on or within the pad. In order to correct damaged surface 110, reconditioning disk 104 is movably applied by actuator 112 to polishing pad 102, e.g., rotated and moved into contact with polishing pad 102 as shown by arrows A. Each diamond 106 typically has a size of no less than 70 μm and no greater than 250 μm.

Figure 2:
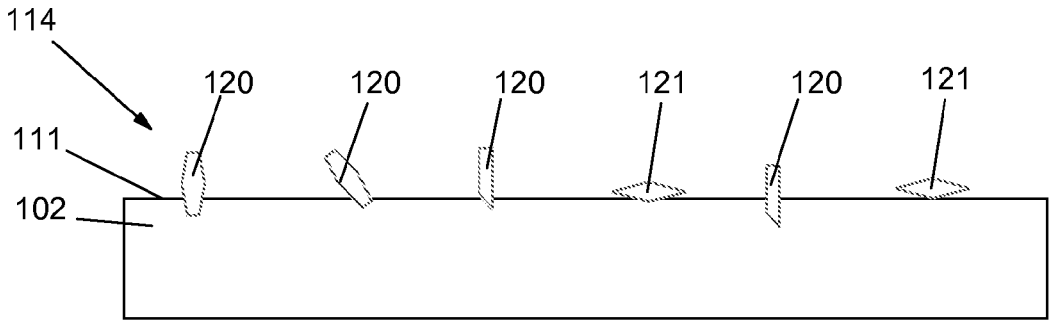
FIG. 2 shows a polishing pad including diamond contamination from the reconditioning disk of FIG. 1.

During application of reconditioning disk 104 to polishing pad 102, diamonds 106 can fall off of reconditioning disk 104 and become embedded in polishing pad 102 or otherwise contacted to polishing pad 102. Any such diamond 106 shall be referred to herein as "diamond contamination." FIG. 2 shows polishing pad 102 including diamond contamination 114 including, for example, at least one embedded diamond 120 in a reconditioned surface 111 thereof and/or at least one diamond 121 otherwise contacting polishing pad 102.

Figure 3:
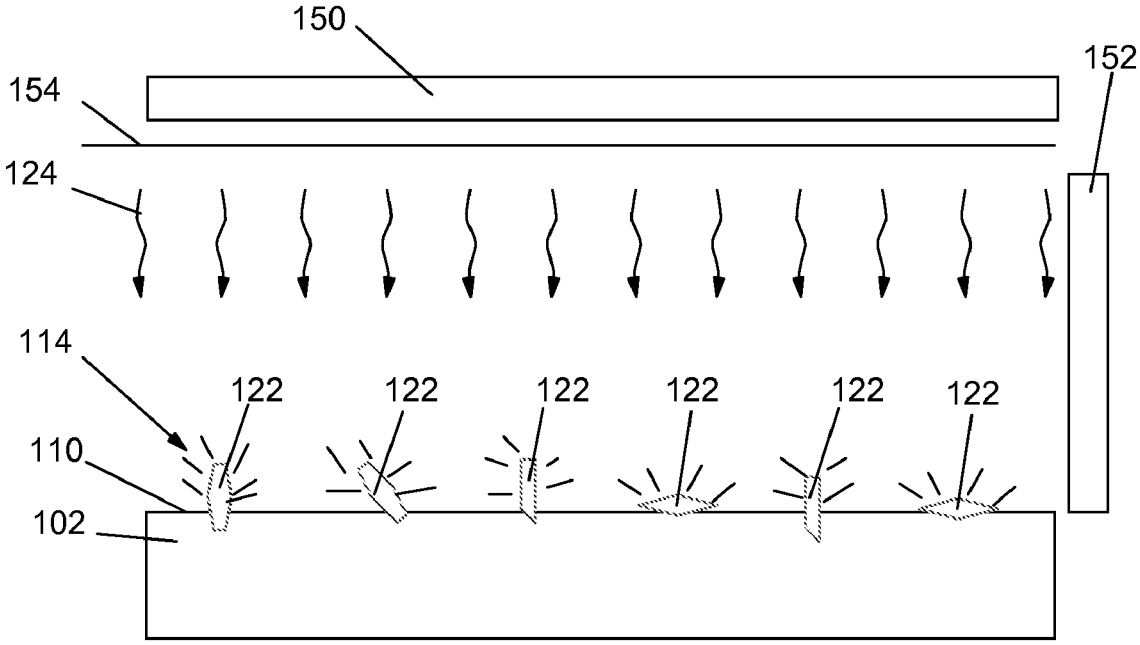
FIG. 3 shows exposure of the polishing pad of FIG. 2 to an energy source to induce the diamond contamination to fluoresce.

FIG. 3 shows the next step of the invention including causing (i.e., inducing) at least part of diamond contamination 114 (FIG. 2) to fluoresce, as shown by fluorescing diamonds 122. In particular, about 50% of diamonds produced have fluorescence that can be observed under special conditions such as short wavelength ultraviolet light. Further, about 10% of diamonds on the market have fluorescence strong enough to make a noticeable difference in the stone's color in incandescent light, which is low in ultraviolet light, and in sunlight or fluorescent light, which are high in ultraviolet light. In one embodiment, this step includes exposing (all or a portion of) the diamond contamination to an energy source 124. Energy source 124 preferably has a short wavelength, e.g., a wavelength of no less than 180 nm and no greater than 400 nm. Energy source 124 may expose diamond contamination 114 to a broad spectrum, such as 200 nm to 300 nm wavelength energy, or discrete wavelengths such as a spectral line of a mercury lamp. In one embodiment, energy source 124 is an ultraviolet light source. The exposure may also include some incandescent light, but typically this should be avoided as it makes the fluorescence harder to detect, and may require filtering. Other mechanisms to induce diamond contamination 114 to fluoresce may also be employed. For example, a mercury lamp, xenon lamp, laser, x-ray, etc., may be used, some of which may require filtering mechanisms for detection, as will be described below.

Next, as also shown in FIG. 3, any fluorescing diamond contamination 114 is detected by the fluorescence by a detector 150 or 152. Since energy is inherently lost in the fluorescence of diamond contamination 114, the detecting step includes detecting fluorescence having a wavelength of no less than the excitation source wavelength, e.g., no less than 200 nm and no greater than 600 nm. Energy source 124 and detector 150 or 152 are selected to allow detection of fluorescence by detector 150 or 152. For example, an appropriate detector 150 or 152 is selected depending on whether energy source 124 has a broad spectrum or discrete wavelengths. In one preferred embodiment, energy source 124 and a detector 152 are selected such that an excitation wavelength range of energy source 124 and a sensitivity wavelength range of detector 152 overlap minimally, e.g., approximately no more than 20 nm. The minimal detector/energy source spectrum overlap simplifies the requirement of the detector geometry since the detector (shown as detector 150 in FIG. 3) can be positioned substantially parallel to energy source 124, i.e., the beam, and polishing pad 102. However, if there is significant detector/energy source spectrum overlap, which results in detector noise background that decreases the sensitivity of the detector to small amounts of diamond contamination 114, then the position of the detector versus energy source 124 must be maintained such that minimal excitation radiation will reach the detector. For example, the detector may have to be placed substantially orthogonal to energy source 124 and/or polishing pad 102 in order to detect the fluorescence (shown as detector 152 in FIG. 3). In either case, fluorescence may be filtered by a filter 154 during the detecting step to prevent detection of noise and/or energy source 124. Although only two positions, i.e., substantially parallel or orthogonal, have been described, it should be recognized that the detector 150, 152 may be positioned at any angle desired to detect fluorescence.

As the detection occurs, the detected diamond contamination may be classified according to an extent of their fluorescence, e.g., by lumens. For example, fluorescing diamond contamination 124 may be classified into at least four classes including faint, medium, strong and very strong.

Figure 4:
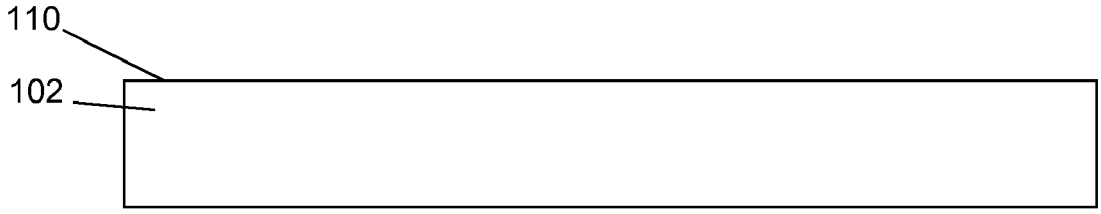
FIG. 4 shows a reconditioned polishing pad having the diamond contamination removed.

Next, as shown in FIG. 4, the diamond contamination is removed from polishing pad 102 in any now known or later developed manner. Alternatively, polishing pad 102 may be discarded if too much diamond contamination is present, and removal would cause too much damage to polishing pad 102.

Figure 5:
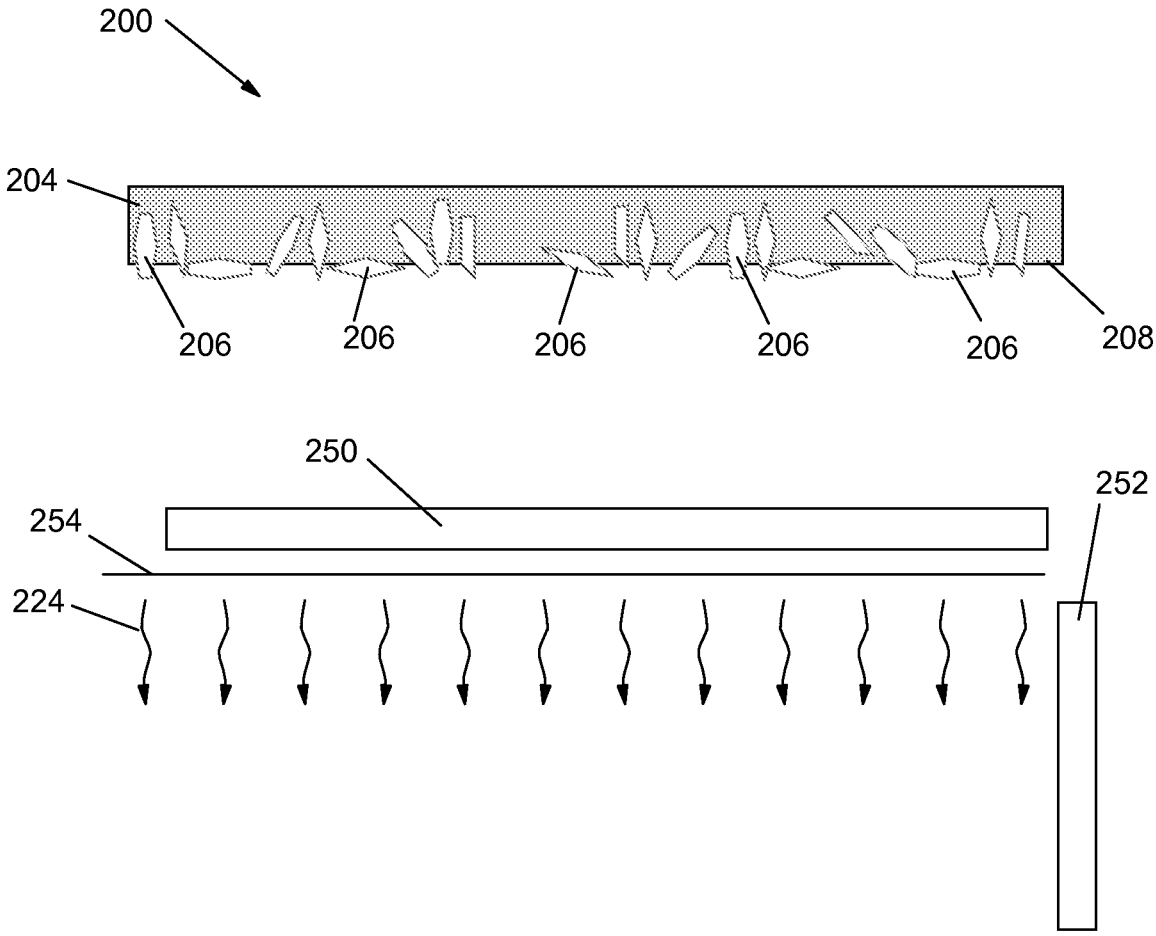
FIG. 5 shows a reconditioning system for a damaged polishing pad according to the invention.

Turning to FIG. 5, in order to improve the likelihood that diamond contamination is detected, the invention also includes a reconditioning system 200 for reconditioning a damaged polishing pad 102 (FIGS. 1-3) having a reconditioning disk 204 including a plurality of diamonds 206, wherein each diamond fluoresces when exposed to an energy source 224. Reconditioning disk 204 is applied to a damaged polishing pad 102 (FIGS. 1-3) for reconditioning damaged polishing pad 102 in any now known or later developed fashion. Reconditioning disk 204, in contrast to conventional disks however, includes only diamonds 206 that fluoresce when exposed to an energy source 224. In particular, as described above, only about 50% of diamonds produced have fluorescence that can be observed under special conditions such as short wavelength ultraviolet light. Further, about 10% of diamonds on the market have fluorescence strong enough to make a noticeable difference in the stone's color in incandescent light, which is low in ultraviolet light, and in sunlight or fluorescent light, which are high in ultraviolet light. Accordingly, while the above-described methods drastically improve reconditioning of a polishing pad 102 (FIGS. 1-4), some diamond contamination may not fluoresce, and therefore, may go undetected. A reconditioning disk 204, as shown in FIG. 5, according to the invention is provided with only diamonds 206 that fluoresce when exposed to an energy source 224, thus ensuring detection of any diamond contamination of polishing pad 102 (FIGS. 1-3). Diamonds 206 are attached to a reconditioning surface 208 of reconditioning disk 204 in any conventional or later developed fashion.

In one embodiment, diamonds 206 selected for use may be classified according to an extent of their fluorescence, e.g., by lumens. For example, diamonds 206 may be classified into at least four classes including faint, medium, strong and very strong. A desired extent of fluorescence can then be achieved. In addition, diamonds 206 may be selected to accommodate a particular energy source 224. For example, where a mercury lamp energy source 224 is used, diamonds 206 that fluoresce when exposed to that mercury lamp's particular spectral line can be selected. However, this feature is not necessary.

Continuing with FIG. 5, reconditioning system 200 also includes energy source 224 for causing diamond contamination of at least one diamond 122 (FIG. 3) of diamonds 206 embedded or contacting polishing pad 102 (FIG. 3) to fluoresce during exposure of the polishing pad by energy source 224. Energy source 224 may be structured and operate according to any one of the above-described embodiments. Reconditioning system 200 also includes a detector 250, 252 for detecting diamond contamination of polishing pad 102 (FIG. 2) by the fluorescence of at least one diamond of the plurality of diamonds 206 embedded or contacting the polishing pad. Detector 250, 252 may be structured and operate according to any one of the above-described embodiments. As described above, detector 250, 252 may be positioned to foster detection of fluorescing diamonds 122 (FIG. 3), e.g., in a plane substantially parallel, substantially orthogonal or any angle desired relative to energy source 124. As also explained above, an excitation wavelength range of energy source 224 and a sensitivity wavelength range of detector 250, 252 may overlap minimally. In one embodiment, energy source 224 has a wavelength of no less than 180 nm and no greater than 400 nm, and detector 250, 252 detects fluorescence having a wavelength of no less than 200 nm and no greater than 600 nm. A filter 254 may also be provided, where necessary, for filtering the fluorescence.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A reconditioning system for reconditioning a damaged polishing pad, the reconditioning system comprising:

a reconditioning disk including a plurality of diamonds for reconditioning the polishing pad, wherein every diamond on the reconditioning disk fluoresces when exposed to a light energy source.

2. The system of claim 1, further comprising a light energy source for causing diamond contamination of at least one diamond of the plurality of diamonds embedded in or contacting the polishing pad to fluoresce during exposure of the polishing pad by the light energy source, wherein the at least one diamond of the plurality of diamonds is embedded in or contacts the polishing pad.

3. The system of claim 2, further comprising a detector for detecting diamond contamination of the polishing pad by the fluorescence of the at least one diamond of the plurality of diamonds embedded in or contacting the polishing pad.

4. The system of claim 3, wherein the detector is positioned in a plane substantially parallel to the light energy source.

5. The system of claim 3, wherein an excitation wavelength range of the light energy source and a sensitivity wavelength range of the detector overlap minimally.

6. The system of claim 3, wherein the light energy source has a wavelength of no less than 180 nm and no greater than 400 nm, and the detector detects fluorescence having a wavelength of no less than 200 nm and no greater than 600 nm.

7. The system of claim 1, further comprising a detector for detecting diamond contamination of the polishing pad by the fluorescence of at least one diamond of the plurality of diamonds embedded in or contacting the polishing pad.

8. The system of claim 7, further comprising a filter for filtering the fluorescence.

* * * * *